US006408823B1

(12) United States Patent
Takahashi et al.

(10) Patent No.: US 6,408,823 B1
(45) Date of Patent: Jun. 25, 2002

(54) FUEL INJECTION CONTROL DEVICE FOR ENGINES

(75) Inventors: Susumu Takahashi; Masaaki Nishitou, both of Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/139,659

(22) Filed: Aug. 25, 1998

(30) Foreign Application Priority Data

Aug. 29, 1997 (JP) ..... 9-247525

(51) Int. Cl.[7] ..... F02M 41/00
(52) U.S. Cl. ..... 123/456
(58) Field of Search ..... 123/456, 446, 123/497, 436

(56) References Cited

U.S. PATENT DOCUMENTS 4,777,921 A * 10/1988 Miyaki ..... 123/456
5,058,555 A * 10/1991 Kondo ..... 123/456
5,094,216 A * 3/1992 Miyaki ..... 123/456
5,109,822 A * 5/1992 Martin ..... 123/456
5,197,438 A * 3/1993 Yamamoto ..... 123/446
5,277,156 A * 1/1994 Osuka ..... 123/456
5,404,855 A * 4/1995 Yen ..... 123/446
5,676,114 A * 10/1997 Tarr ..... 123/446
5,678,521 A * 10/1997 Thompson ..... 123/446

FOREIGN PATENT DOCUMENTS

JP 6350649 3/1988

* cited by examiner

*Primary Examiner*—Carl S. Miller
(74) *Attorney, Agent, or Firm*—Browdy and Neimark

(57) ABSTRACT

The fuel injection control device for engines minimizes variations of the pressure of the common rail that stores fuel, by equalizing the amount of fuel delivered by pump chambers of the fuel pump. For example, the common rail pressure that has fallen as a result of fuel injection by the secondly-operated injector is recovered to the pressure Pf(2) by the fuel delivered from the pump chamber containing the thirdly-operated piston. The difference between the recovered pressure Pf(2) and the common rail pressure Pf(1) that was recovered following the preceding fuel injection has a correlation with the amount of fuel delivered from the corresponding pump chamber. In this way, based on the difference between the common rail recovery pressures provided by the fuel delivered from the successively operated pump chambers, the amount of fuel delivered from each pump chamber is regulated to control the recovered common rail pressure.

4 Claims, 10 Drawing Sheets

FUEL INJECTION CONTROL DEVICE FOR ENGINES

BACKGROUND OF THE INVENTION

1. Field of the Invention

The present invention relates to a fuel injection control device for engines with a common-rail type fuel injection system which stores in a common rail a fuel pressurized to a predetermined pressure by a fuel pump and injects the stored fuel from injectors into combustion chambers.

2. Description of the Prior Art

As for the fuel injection control in engines, a common-rail type fuel injection system has been known which provides a high injection pressure and performs optimum control on injection characteristics, such as fuel injection timing and the amount of fuel injected, according to the operating condition of the engine. The common-rail type fuel injection system is a fuel injection system that stores in the common rail a fuel pressurized to a predetermined pressure by a pump and then injects the stored fuel from injectors into corresponding combustion chambers. To ensure that the pressurized fuel will be injected from each injector under optimum injection conditions according to the engine operating conditions, a controller controls the fuel pressure in the common rail and the operation of control valves for the injectors according to the operating conditions of the engine.

The conventional common-rail type fuel injection system will be described by referring to FIG. 11. The fuel is supplied to individual injectors 1 from a common rail 2 through branch pipes 3 that form a part of the fuel passage. The fuel, which was pumped by a feed pump 6 from a fuel tank 4 through a filter 5 and pressurized to a predetermined pressure, is delivered to a fuel pump 8 through a fuel pipe 7. The fuel pump 8 may, for example, be a so-called plunger type fuel supply pump driven by the engine which raises the fuel pressure to a high pressure determined by the operating condition of the engine and delivers the pressurized fuel through a fuel pipe 9 to the common rail 2. The fuel is then stored temporarily in the common rail 2 at the elevated pressure, from which it is supplied to individual injectors 1. Normally there are provided two or more injectors 1 corresponding in number to cylinders in the engine (or according to the type of engine). These injectors 1 are controlled by a controller 12 to inject fuel supplied from the common rail 2 into the corresponding combustion chambers in optimum amounts and at optimum timings. Because the pressure at which the fuel is injected from the injectors 1 is equal to the pressure of the fuel stored in the common rail 2, the injection pressure is controlled by controlling the fuel pressure in the common rail 2.

The fuel flowing from the feed pump 6 into the fuel pump 8 is controlled by a flow control valve 10. Of the fuel supplied from the branch pipes 3 to the injectors 1, the fuel that was not used for injection into the combustion chambers is returned to the fuel tank 4 through a return pipe 11. The controller 12 as an electronic control unit (ECU) is supplied with information on the engine operating condition from various sensors, which include: engine cylinder determination and crank angle sensors for detecting an engine revolution speed Ne, determining the cylinders into which the fuel needs to be injected and calculating the injection timing; an accelerator opening sensor for detecting the accelerator control input Acc such as an accelerator depression; a water temperature sensor for detecting the cooling water temperature; and an intake pipe inner pressure sensor for detecting the inner pressure of the intake pipe. The controller 12, based on these signals, controls the fuel injection characteristics of the injectors 1, i.e., the fuel injection timing and the amount of fuel to be injected (injection pressure and injection period) so that the operation characteristics such as engine output, exhaust gas and mileage will become optimum for the current engine operating condition. The common rail 2 is provided with a pressure sensor 13 which detects the fuel pressure in the common rail 2 and sends the detection signal to the controller 12. Once the fuel is injected from the injectors 1, the fuel in the common rail 2 is consumed reducing the pressure in the common rail 2. The controller 12 controls the flow control valve 10 to regulate the amount of fuel delivered by the fuel pump 8 to the common rail 2 so as to maintain the fuel pressure in the common rail 2 at a preset pressure.

An example of the conventional fuel injection control device for internal combustion engines is disclosed in Japanese Patent Laid-Open No. 50649/1988. This fuel injection control device for internal combustion engines comprises a common rail of a certain volume, a fuel supply pump to deliver fuel to the common rail through the fuel supply passage, fuel injection valves to inject fuel supplied to the common rail into the combustion chambers, a flow regulating valve to regulate the amount of fuel flowing from the fuel tank to the fuel supply pump, a pressure detection means to detect a common rail pressure, an operating condition detection means to detect the operating condition of the internal combustion engine, a pressure setting means to set a target pressure of the common rail based on the result of detection by the operating condition detection means, and a pressure control means to control the flow regulating valve according to the result of detection by the pressure detection means and also control the common rail pressure to the target pressure.

With the fuel injection control device for internal combustion engines disclosed in the above official gazette, a flow control valve for controlling the fuel flow from the fuel tank is installed at the suction side of the fuel supply pump that supplies a high-pressure fuel to the fuel injection valves through the fuel supply passage including the common rail. The flow control valve is controlled by the pressure control means to eliminate the deviation between the target fuel pressure in the fuel supply passage, which is set according to the result of detection by the engine operating condition detection means, and the actual fuel pressure in the fuel supply passage. The control of fuel flow performed by the flow control valve is done by changing the cross section of the fuel passage or by controlling the duty ratio to change the valve opening time. When the actual fuel pressure in the fuel supply passage is detected to be higher than the target fuel pressure by more than a predetermined threshold range, the flow control valve performs control to reduce the fuel flow to the fuel supply pump. This in turn reduces the fuel flow delivered by the fuel supply pump to the common rail, resulting in an immediate reduction in the fuel pressure in the pressure accumulation chamber.

The fuel supply pump used in the above fuel injection control device has a stationary shaft fixedly supported in a pump casing, a rotor turning around the stationary shaft, and a ring rotatably supported on the pump casing through a bearing. The rotor has many radial pistons arranged radially therein and shoes inserted between each radial piston and the ring that rotate with the radial pistons. The stationary shaft is formed with a suction port communicating with the flow regulating valve and a delivery port communicating with the common rail. As the rotor turns, the cylinder chambers in which each radial piston reciprocates are brought into communication with the suction port and the delivery port alternately. The alternate communication is synchronized with radially outward or inward displacement of the radial pistons causing the fuel to be discharged from the delivery port.

How the common rail pressure changes is shown at the common rail pressure P in the graph of FIG. 1. The graph of FIG. 1 represents a four-cylinder engine with a one-to-one correspondence between each pump chamber and the injector of each cylinder into which the fuel is to be injected. The cylinder determination sensor generates a cylinder determination signal (REF signal) at a position 120° crank angle before the top dead center of No. 1 piston (firstly-operated piston). A before-top-dead-center sensor generates a before-top-dead-center (BTDC) signal at a position 60° crank angle before the top dead center for each piston.

Immediately before the pistons reach their top dead centers one after another, a drive pulse to drive an on-off valve such as a needle valve that directly controls the fuel injection from the injector corresponding to the cylinder of interest is generated. A drive pulse Ip1 fed to No. 1 injector (firstly-operated injector) corresponding to No. 1 cylinder (firstly-operated cylinder) activates the firstly-operated injector. When the firstly-operated injector injects fuel, the common rail pressure decreases as shown at Pd1. When the fuel injection from the firstly-operated injector is finished, however, No. 2 piston (secondly-operated piston) of the fuel pump that has already entered the delivery process delivers the fuel from No. 2 pump chamber (secondly-operated pump chamber) and thus the common rail pressure recovers as shown at Pf(1). Next, as a drive pulse Ip2 is sent to No. 2 injector (secondly-operated injector) to inject fuel, the common rail pressure falls again as shown at Pd2. But because the fuel is delivered from No. 3 pump chamber (thirdly-operated pump chamber), the common rail pressure recovers again as shown at Pf(2). In this way, the common rail pressure repeats the process of falling as a result of fuel injection performed successively by the injectors (as shown at Pd1, Pd2, Pd3, Pd4) and then recovering by the fuel delivery from the pump chambers of the fuel pump (as shown at Pf(1), Pf(2), Pf(3), Pf(4)).

In the common-rail type fuel injection device which controls the fuel flow from the pump by means of a pump inlet flow control valve and which uses a plurality of pump chambers operated successively at each fuel injection from the injectors, pressure variations are caused in synchronism with the pump rotation period by variations specific to the individual pump chambers such as dimensional variations and operation timing variations. The dimensional variations include those of the pistons and cylinders, of the slits and other portions of the flow control valves, and of the fuel passages and check valves corresponding to the individual pump chambers of the fuel pump. That is, as shown at the common rail pressure P in the graph of FIG. 1, the common rail pressure that is recovered by the fuel delivered by the successively activating pump chambers is not constant on each recovery but differs from one recovery to another, varying in synchronism with the pump rotation period. The similar phenomenon occurs also when the flow control valve is installed at the delivery side of the fuel pump. The fuel injection control device disclosed in the above official gazette, however, does not consider the variations among the cylinders of the fuel supply pump and the resulting common rail pressure variations.

When there are variations in the amount of fuel delivered, the pressure at which the fuel starts to be injected differs among the cylinders from the target injection pressure even when the engine is running in a steady state. If the common rail pressure, which is recovered by the fuel delivered from the fuel pump having a plurality of pump chambers, varies from one recovery to another, the engine output is likely to vary especially when engine revolution speed is low, causing engine vibrations and noise, leading to increased exhaust emissions. This tendency is significant particularly when the engine is idling. Hence, to reduce variations in the amount of fuel injected from the injectors and stabilize the rotation of the engine output shaft during the idling to reduce engine vibrations and noise and prevent deterioration of exhaust emissions, there are demands for equalizing the amounts of fuel delivered successively from individual pump chambers of the fuel pump to reduce variations in the recovery pressure of the common rail after each fuel injection.

SUMMARY OF THE INVENTION

The object of this invention is to solve the above problems and to provide a fuel injection control device for engines which-based on that fact that in a common-rail type fuel injection system variations of the common rail pressure recovered following the pressure drop caused by fuel injection have a correlation with variations of the amount of fuel delivered by each piston-corrects the operation of the flow control valve at a timing that the corresponding piston is in a suction stroke according to the deviation of the recovered common rail pressure so as to equalize a common rail pressure.

This invention relates to a fuel injection control device for engines which comprises: a common rail to store fuel delivered by a fuel pump; injectors to inject fuel supplied from the common rail into combustion chambers; a pressure sensor to detect a pressure of the common rail; and a controller to control the amount of fuel delivered from the fuel pump according to the pressure of the common rail detected by the pressure sensor; wherein the fuel pump has pump chambers that are successively activated to deliver fuel each time the injectors have injected fuel; wherein, based on the difference between the common rail recovery pressures provided by the fuel delivered from two successively operated pump chambers of the fuel pump, the controller controls the amount of fuel delivered by the second-operated of the two pump chambers in order to minimize variations of the common rail pressure.

Because this fuel injection control device is constructed as described above, when the common rail pressures that are recovered by the fuel delivered from the successively operated two of the pump chambers of the fuel pump differ from each other, this pressure difference has a correlation with the amounts of fuel delivered from the two successively operated pump chambers. Hence, based on the pressure difference, the amounts of fuel to be supplied to the pump chambers are controlled to equalize the amounts of fuel delivered from these pump chambers, thus reducing the variations of the common rail pressure. This in turn stabilizes the amounts of fuel injected from the injectors that receive fuel from the common rail, contributing in particular to stabilization of the engine output shaft rotation during idling, reducing the engine vibrations and noise and preventing deterioration of exhaust emissions.

The control on the amount of fuel delivered by the fuel pump is performed by controlling a flow control valve provided on the inflow side of the fuel pump to control the amount of fuel supplied to the pump chambers. Changing the amount of fuel supplied to each pump chamber of the fuel pump as by controlling the opening of the flow control valve changes the amount of fuel delivered from the corresponding pump chamber.

An operation state detection means for detecting an operating state of the engine is provided, and the controller determines a target pressure of the common rail based on the operating state of the engine detected by the operation state detection means and controls the flow control valve to match the pressure of the common rail with the target pressure. Generally, the common rail target pressure is determined according to the operating state of the engine, i.e., whether the engine is in a non-steady state such as acceleration or deceleration, or to the magnitude of load, and the flow control valve is controlled so that the common rail pressure will match the target pressure.

Further, the control on the amount of fuel delivered from the fuel pump based on the difference between the recovered common rail pressures is performed when the engine operation state detected by the operation state detection means indicates idling and the target pressure of the common rail is equal to or less than a predetermined threshold value. As described earlier, the effects the common rail pressure variations have on the engine revolution speed variations are greatest during the idling. Hence, by performing the common rail pressure equalization control based on the difference between the successive common rail recovery pressures at least when the engine is idling and is in a stable state where the common rail target pressure does not change in excess of the predetermined threshold range, the vibrations, noise and exhaust emissions characteristics can effectively be improved.

DETAILED DESCRIPTION OF THE EMBODIMENT

One embodiment of the fuel injection control device of the present invention will be described by referring to the accompanying drawings.

Figure 11:
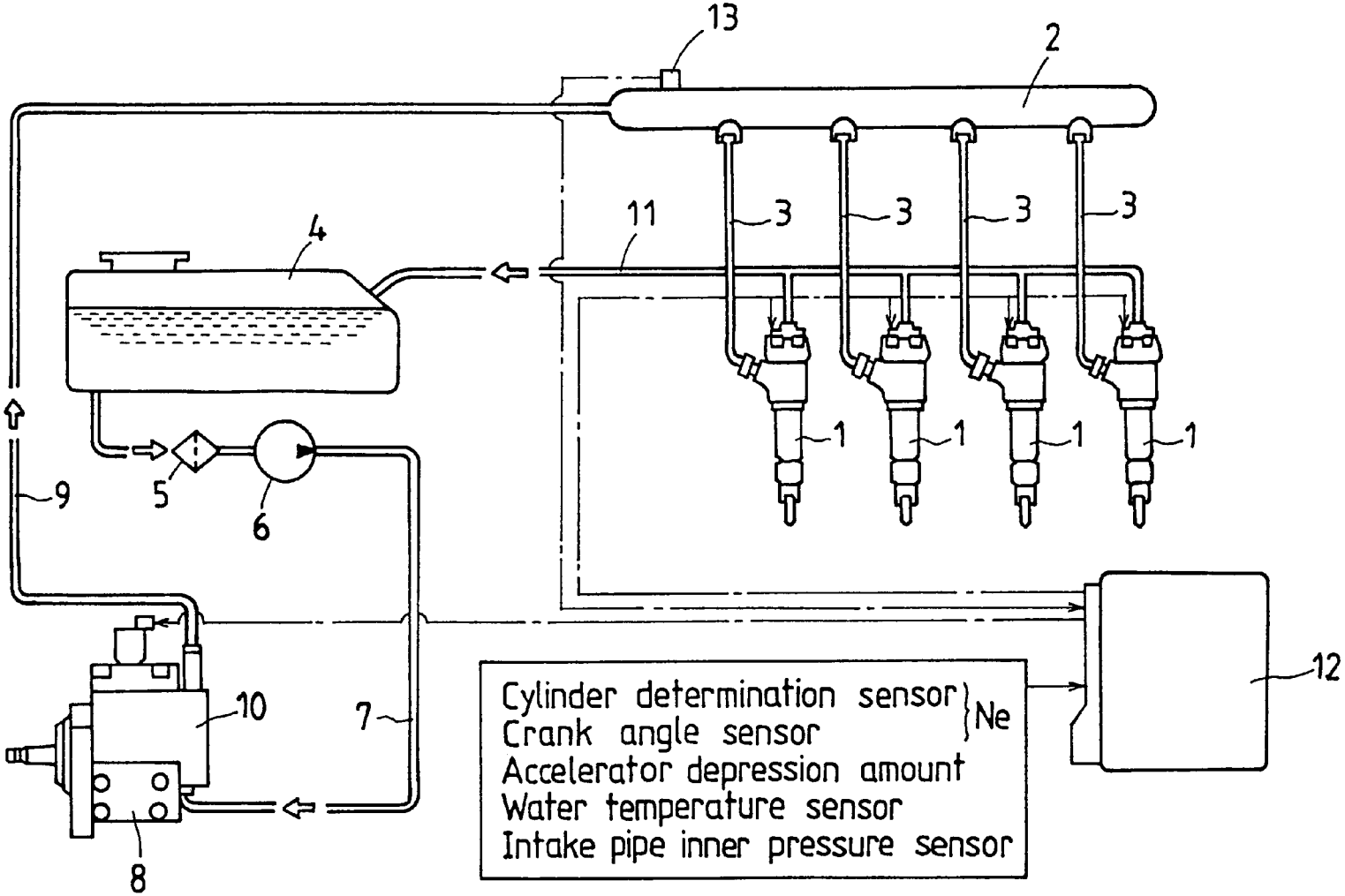
FIG. 11 is a schematic diagram of a common-rail type fuel injection system.

The system that applies the control device of this invention may use the common-rail type fuel injection system shown in FIG. 11. Thus, the constitutional elements identical with those used in FIG. 11 are assigned like reference numerals and their repetitive explanations are omitted.

Figure 9:
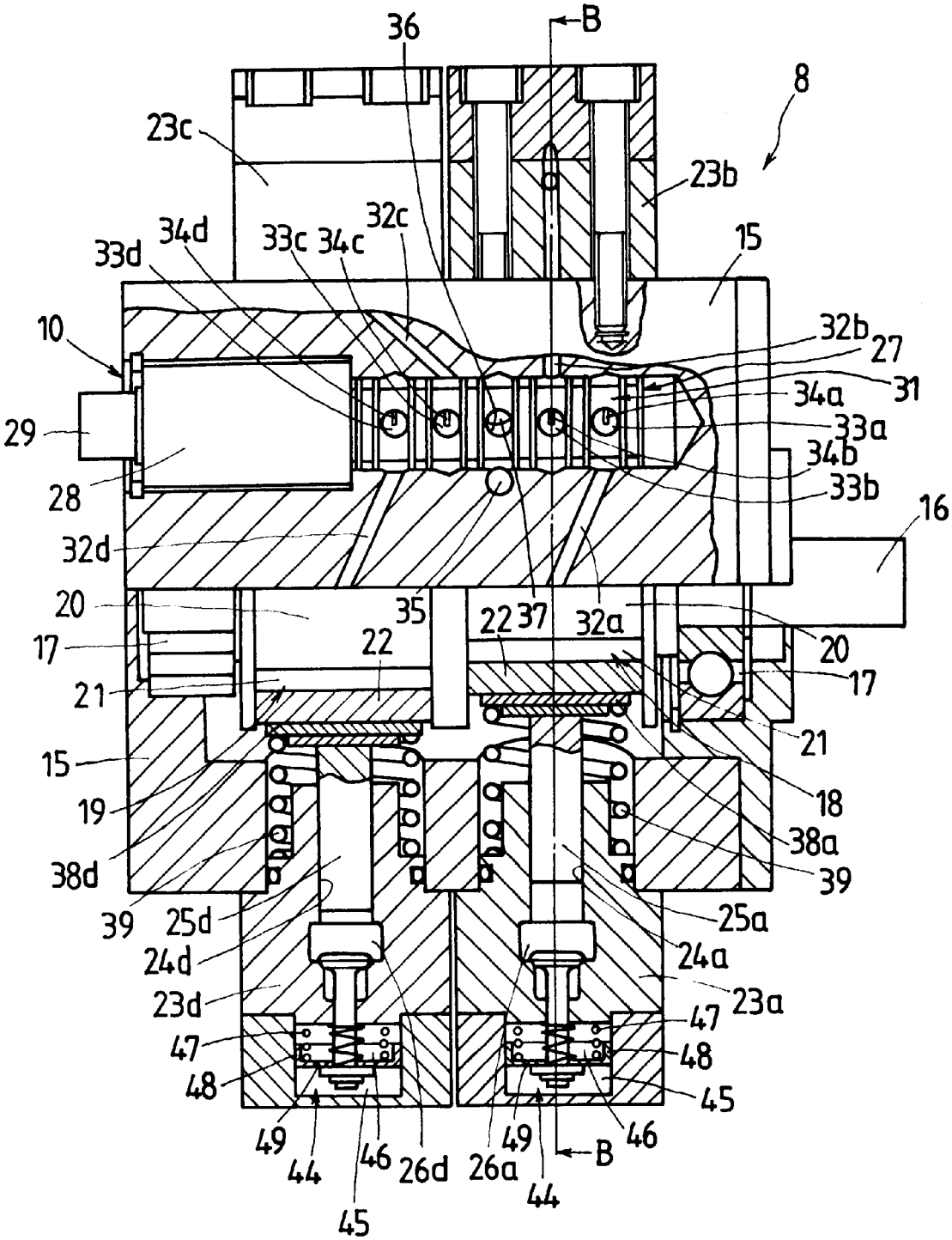
FIG. 9 is a vertical cross section, taken along the line A—A of FIG. 10 and seen in the direction of the arrow, of the fuel pump applied to the fuel injection control device for engines of this invention.
Figure 10:
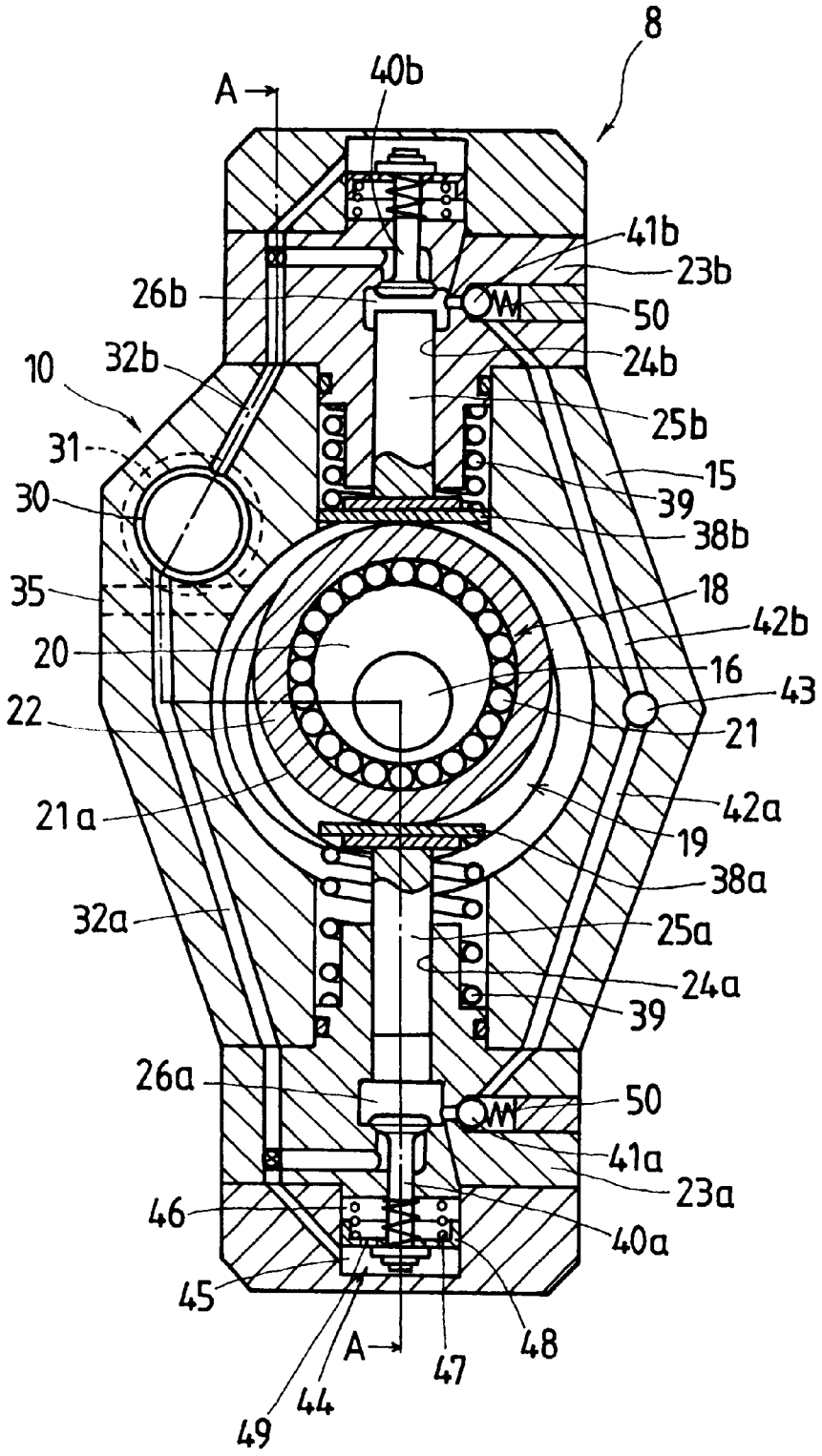
FIG. 10 is a transverse cross section of the fuel pump taken along the line B—B of FIG. 9.

Referring to FIGS. 9 and 10, a variable displacement fuel pump will be explained. The fuel pump has a drive shaft 16 rotatably supported through bearings 17 in its pump body 15 so that the drive shaft 16 can be driven by the engine with its speed reduced to one-half that of the engine. Mounted on the drive shaft 16 at axially spaced positions are two cams 18, 19 having circular outlines offset with respect to the drive shaft 16. The cams 18, 19 comprise cam plates 20 mounted on the drive shaft 16, rings 21 disposed around the cam plates 20 and needle bearings 22 inserted in annular spaces between the cam plates 20 and the rings 21. Thus, the rings 21 are rotatable around the cam plates 20 through the needle bearings 22.

For each of the cams 18, 19 there are two similar pump mechanisms arranged opposite each other on both sides of the drive shaft 16. That is, a total of four pump mechanisms are installed. Now one of the pump mechanisms will be explained with a reference symbol (a) attached to its reference numbers and the description of this pump mechanism also applies to other pump mechanisms (b, c, d) unless otherwise specifically stated. Each pump mechanism has its cylinder block 23*a* arranged at one of the opposed positions with the drive shaft 16 interposed between. The cylinder block 23*a* is formed with a cylinder bore 24*a* extending radially outwardly. The cylinder bore 24*a* and a piston 25*a* sliding in the cylinder bore 24*a* form a pump chamber 26*a*. Thus, the fuel pump 8 is a piston-reciprocating type pump having four sets of cylinder and piston.

The means that varies the amount of fuel delivered by the fuel pump 8 is a fuel control valve 10 that controls the fuel flow supplied to the fuel pump 8. The fuel control valve 10 comprises a valve disk 27 of opening adjust type and a motor 28. The motor 28 is connected through a connector 29 to the controller (electronic control unit ECU) 12 and receives a control signal from the controller 12 to rotate the valve disk 27 and thereby control the amount of fuel delivered by the fuel pump 8. The valve disk 27 has two concentric cylindrical bodies 30, 31, with the inner cylindrical body 30 secured to the output shaft of the motor 28 and the outer cylindrical body 31 to the pump body 15.

The outer cylindrical body 31 is formed with a hole 33*a* communicating with the corresponding pump chamber 26*a* through an inflow passage 32*a* formed in the pump body 15 and the cylinder block 23*a*. The inner cylindrical body 30 is formed with a slit 34*a* at a position corresponding to the hole 33*a* of the outer cylindrical body 31. A fuel inlet 35 formed in the pump body 15 communicates with a fuel supply hole 36 formed in the outer cylindrical body 31 and with a fuel supply hole 37 formed in the inner cylindrical body 30. The fuel, which is pressurized to a low pressure and supplied from the fuel inlet 35 into the pump body 15 by the feed pump 6, flows into the inner cylindrical body 30 through the fuel supply hole 36 of the outer cylindrical body 31 and the fuel supply hole 37 of the inner cylindrical body 30.

Rotation of the output shaft of the motor 28 controls the rotation angle of the inner cylindrical body 30 with respect to the outer cylindrical body 31. The fuel that has entered into the inner cylindrical body 30 is metered by the opening area of the slit 34*a* of the inner cylindrical body 30 as seen from the hole 33*a* of the outer cylindrical body 31, and is supplied through the inflow passage 32*a* to the corresponding pump chamber 26*a*.

The piston 25*a* has a sliding contact plate 38*a* at its radially inner end and a coil spring 39 interposed between the sliding contact plate 38*a* and the cylinder block 23*a* urges the piston 25*a* radially inwardly at all times. Hence, the sliding contact plate 38*a* will follow an outer circumferential surface 21*a* of the ring 21 of the corresponding cam 18, 19.

In the cylinder block 23*a*, a check valve 40*a* is installed at the inlet side of the pump chamber 26*a*, i.e., in the inflow passage 32*a* and another check valve 41*a* is also provided at the outlet side of the pump chamber 26*a* to restrict the fuel to flow only in the direction from the inflow passage 32*a* toward the outflow passage 42*a*. The outlet side of the pump chamber 26*a* communicates through the outflow passage 42*a* to a delivery port 43, which is connected to the common rail 2. The check valve 40*a* has a damper mechanism 44, in which a partition wall 48 that separates a first chamber 45 introduced with a pressure from the inflow passage 32*a* and a second chamber 46 accommodating a spring 47 is formed with an orifice 49 to damp unwanted vibrations of the check valve 40*a*.

The outlines of the cams 18, 19 are so determined that the four pump mechanisms successively perform the suction and delivery operation 90 degrees apart. In each pump mechanism, as the piston 25*a* moves radially inwardly in response to the operation of the cam 18, the pressure in the pump chamber 26*a* decreases and when the fuel pressure difference between the inflow passage 32*a* and the pump chamber 26*a* becomes higher than the force of the spring 47 of the check valve 40*a*, the check valve 40*a* opens admitting the fuel into the pump chamber 26*a*. Next, when the cam 18 moves the piston 25*a* radially outwardly, the fuel pressure in the pump chamber 26*a* increases and acts to close the check valve 40*a*. When the pressure difference between the outflow passage 42*a* and the pump chamber 26*a* becomes larger than the force of the spring 50 of the check valve 41*a* on the outlet side, the check valve 41*a* opens allowing the fuel to be delivered from the delivery port 43 to the common rail 2. For example, if the fuel delivery from the pump chamber 26*a* is made to correspond to a recovery pressure Pf(1) of the common rail 2, then the fuel deliveries from the pump chambers 26*c*, 26*b*, 26*d* correspond to recovery pressures Pf(2), Pf(3), Pf(4) of the common rail 2, respectively.

In the fuel pump 8 of this kind, as explained earlier, because the fuel delivered from each pump chamber 26*a* passes through the slit 34*a*, inflow passage 32*a*, check valve 40*a*, check valve 41*a*, pump chamber 26*a* and piston 25*a*, the amount of fuel delivered varies among the different pump chambers, affected by manufacture and assembly variations of these components. The proportion of this variation to the amount of fuel delivered increases as the amount of fuel delivered decreases.

Figure 1:
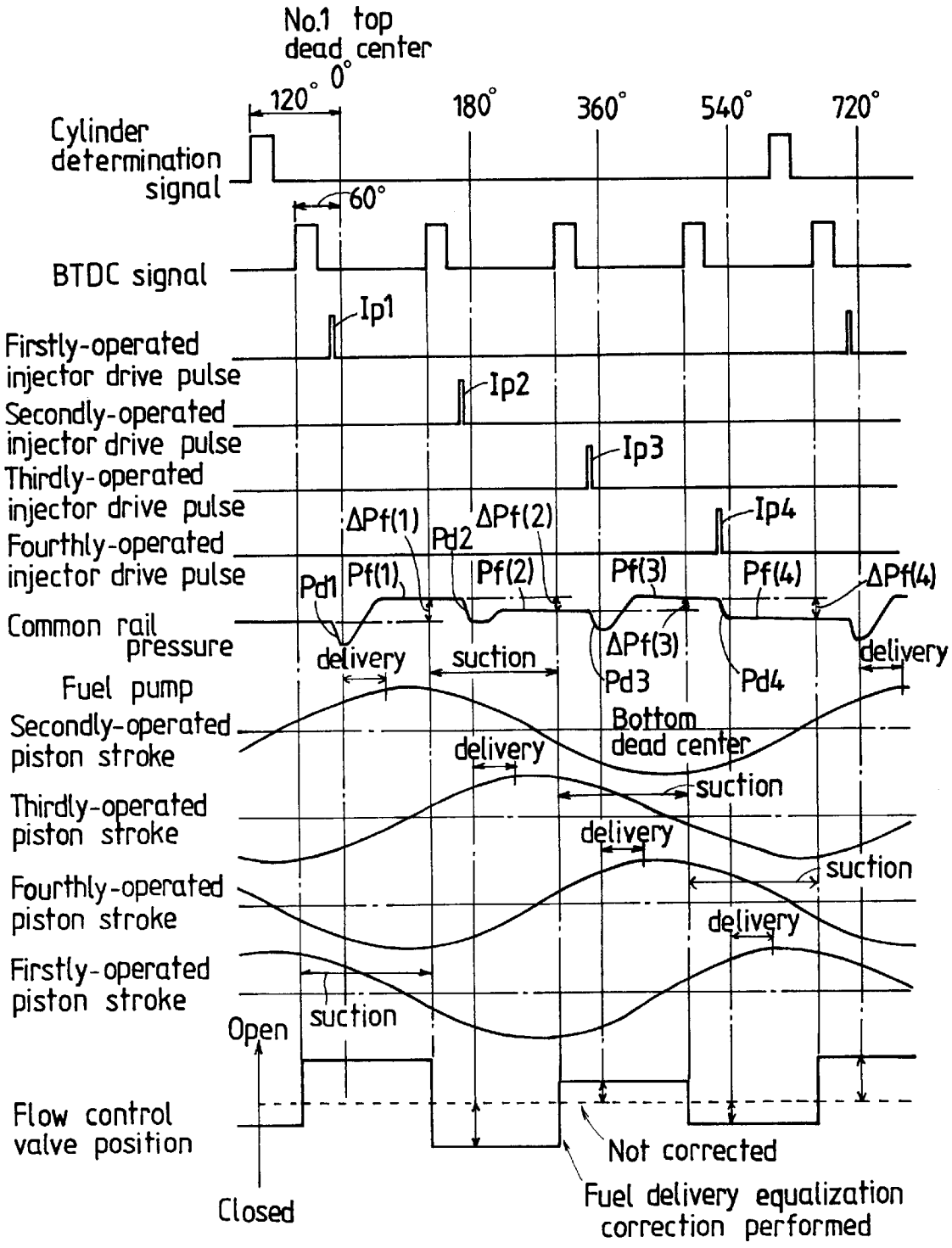
FIG. 1 is a graph showing drive pulses for injectors, common rail pressure, stroke of each piston of the fuel pump, and the operation of the flue control valve of the fuel injection control device of this invention, all these related to the engine cylinder determination signal and the BTDC signal.

In FIG. 1, as explained before, the BTDC (before-top-dead-center) sensor as an engine revolution speed sensor and the cylinder determination sensor are used to detect the fuel injection timing and the pump delivery timing. The cylinder determination sensor issues a signal 120° before the top dead center of the firstly-operated cylinder. That is, in the case of a four-cylinder engine, a cylinder determination signal REF is output once for each 720° crank angle. The BTDC sensor outputs a signal 60° before the top dead center for each cylinder. That is, in the case of a four-cylinder engine, a BTDC signal is output once for every 180° crank angle.

Figure 2:
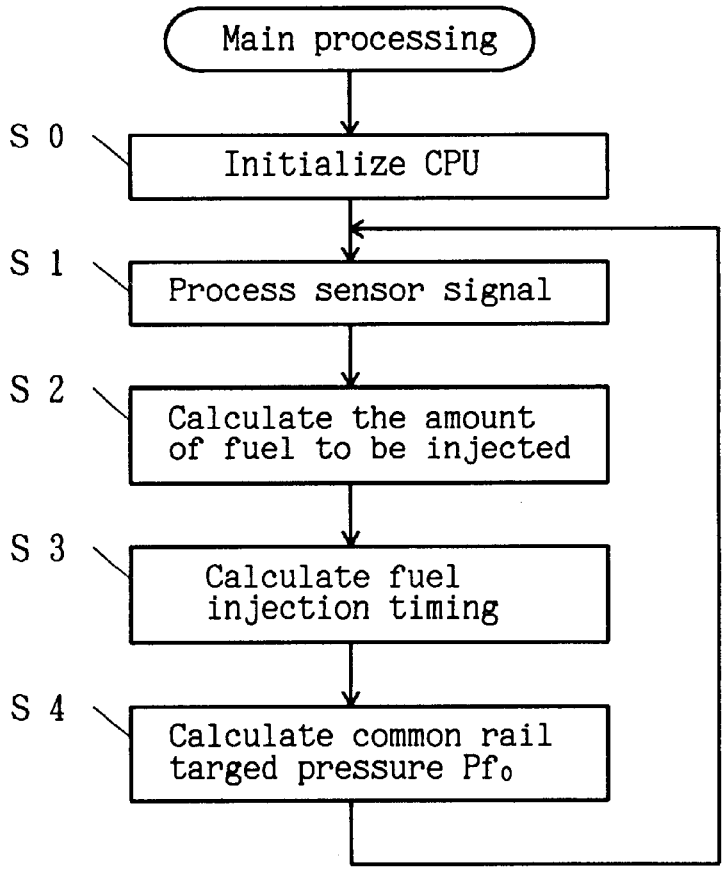
FIG. 2 is a flowchart showing the main processing performed by the fuel injection control device of this invention.

Next, by referring to FIG. 2, the fuel injection control processing performed by CPU will be explained. The main processing shown in FIG. 2 performs initialization of CPU of the controller 12 (step S0), sensor signal processing of the cylinder determination signal and the BTDC signal (step S1), calculation of the amount of fuel to be injected (step S2), calculation of the fuel injection timing (step S3), and calculation of common rail's target pressure $PF_0$ (step S4). The target pressure $Pf_0$ of the common rail, i.e., the target fuel injection pressure, is calculated from the amount of fuel to be injected and the engine revolution speed, both determined according to the engine operating condition, by using a preset injection pressure characteristic map.

Figure 3:
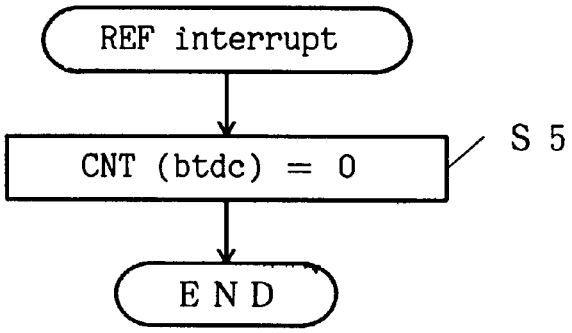
FIG. 3 is a flowchart showing an interrupt processing in the fuel injection control device of this invention generated by the cylinder determination signal.

FIG. 3 is a flowchart showing an interrupt processing generated by the cylinder determination signal. As shown in FIG. 3, in the signal processing at S1 a REF signal interrupt is activated in synchronism with the cylinder determination (REF) signal to reset a cylinder determination counter CNT (btdc) (step S5). The cylinder determination counter CNT (btdc) is counted corresponding to each cylinder, from 0 to 3. Each time the fuel injection cycle is completed for all cylinders, the cylinder determination counter CNT (btdc) is reset.

A BTDC signal interrupt is activated in synchronism with the BTDC signal. The BTDC signal interrupt performs the following processing according to the flowchart of FIG. 4.

(1) Engine revolution speed is calculated (step S10).

(2) According to the value (0–3) of the cylinder determination counter CNT (btdc) at time of interrupt, the cylinder to be fuel-injected next is determined (step S11, S14, S17, S20); the injector processing is performed, i.e., the main injection pulse width is calculated (step S13, S16, S19, S23); and the main injection counter is set with the injection timing and the pulse width. At the same time, the fuel delivery equalization correction (step S12, S15, S18, S21) is performed and, when the value of the cylinder determination counter CNT (btdc) is 3, the fuel delivery equalization correction amount Au is calculated (step S22). Finally, the cylinder determination counter CNT (btdc) is updated (at step S24, i.e., it is reset at step S5). The values (0–3) of the cylinder determination counter CNT (btdc) correspond to the cylinders provided with firstly- to fourthly-operated injectors 1, respectively.

The fuel delivery equalization correction at step S12, S15, S18, S21 is performed as follows according to the flowchart of FIG. 5:

(1) Whether the engine is idling or not (step S30) is determined. For example, when the engine revolution speed is found to be lower than a predetermined value and the accelerator depression smaller than a predetermined value, it is decided that the engine is idling.

(2) When step 30 determines that the engine is idling, it is checked whether the change in the common rail's target pressure $Pf_0$ is larger than the threshold value (i.e., the engine is not in a stable state but in a transient state) (step S31).

(3) When step S31 determines that the change in the common rail target pressure $Pf_0$ is smaller than the threshold value and that the engine is in a stable state, the common rail fuel pressure, i.e., common rail pressure Pf(i) is read in (step S32), where i denotes an injection sequence number 1 to 4 which is assigned to each injection after the cylinder to be fuel-injected is determined. The pistons of the pump that deliver fuel before each injection are also numbered from 1 to 4 (FIG. 1).

(4) The pressure after the fuel delivery from the pump is almost constant until the next injection. The pressure deviation ΔPf(i) between the pressure detected after fuel delivery from the pump and the pressure detected as a result of the previous BTDC signal interrupt is determined (step S33). It is assumed that Pf(0)=Pf(4) (previous pressure).

$$\Delta Pf(i)=Pf(i)-Pf(i-1)$$

For example, the common rail pressure that is read in for the processing of No. 2 injector is the common rail pressure Pf(1) after the fuel has been delivered by No. 2 piston of the fuel injection pump. Then, the fuel delivery by No. 3 piston of the fuel injection pump recovers the common rail pressure to Pf(2). The pressure deviation ΔPf(2) between Pf(2) and Pf(1) has a correlation with the difference between the amounts of fuel delivery by No. 2 piston and No. 3 piston.

Figure 6:
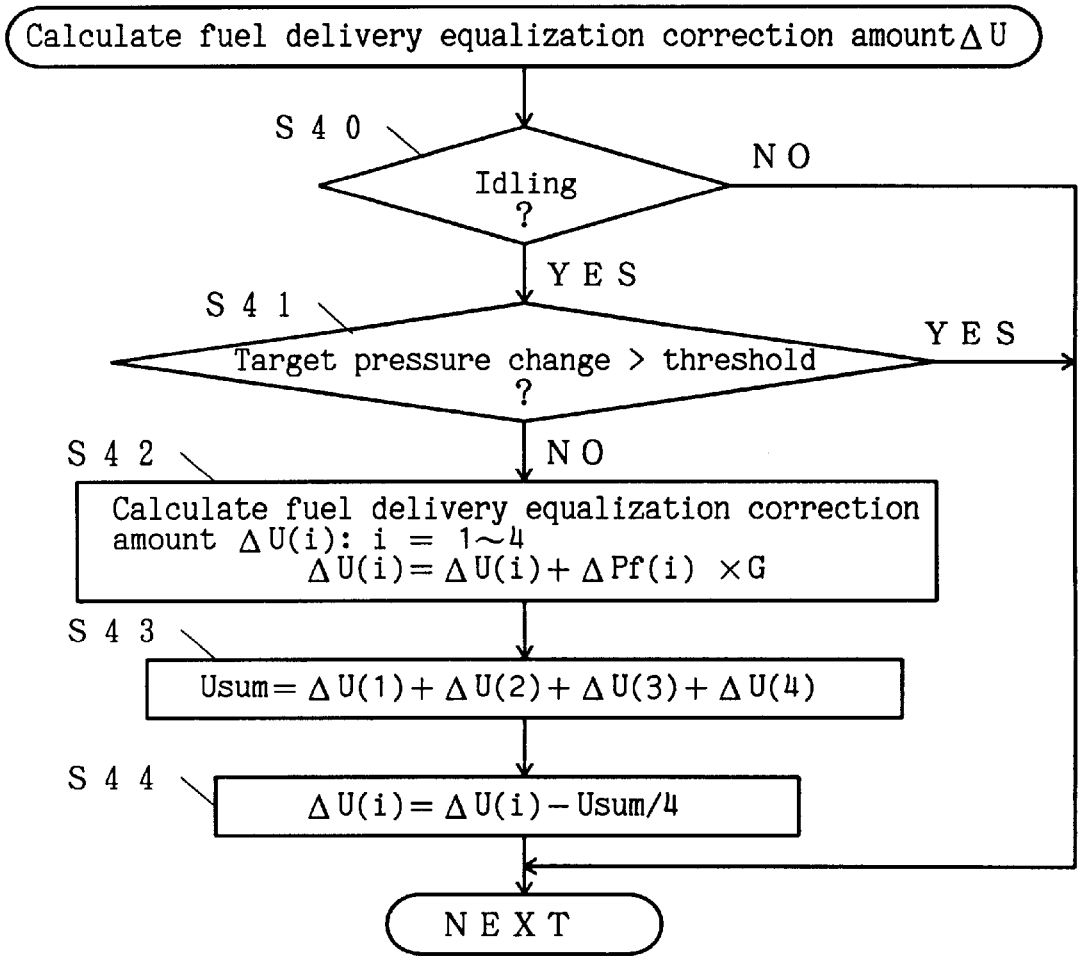
FIG. 6 is a flowchart showing the details of a processing, shown in FIG. 4, for calculating a fuel delivery equalization correction amount ΔU.

(5) Next, the fuel delivery equalization correction is performed on the pump piston that is about to draw in fuel. Let us consider, for example, that fuel is about to be drawn into No. 3 pump chamber. The fuel thus drawn in is used to recover the pressure fall resulting from the injection of No. 2 injector in the next or later cycle (more precisely in the cycle after the next considering the time required for calculation). The fuel delivery equalization correction amount ΔU(2) calculated using the ΔPf(i) by step S44 in the flowchart of FIG. 6 is written into ΔU (step S34). When the BTDC signal and the pump suction are not in phase, an appropriate delay needs only to be given to the correction amount write timing.

The fuel delivery equalization correction amount ΔU is calculated as follows according to the flowchart of FIG. 6:

(1) It is checked whether the engine is idling (step S40). The decision is made in the same way as step S30.

(2) When step S40 decides that the engine is idling, a check is made of whether the change in the common rail target pressure $Pf_0$ is larger than the threshold value (i.e., the engine is not in a stable state but in a transient state) (step S41).

Figure 4:
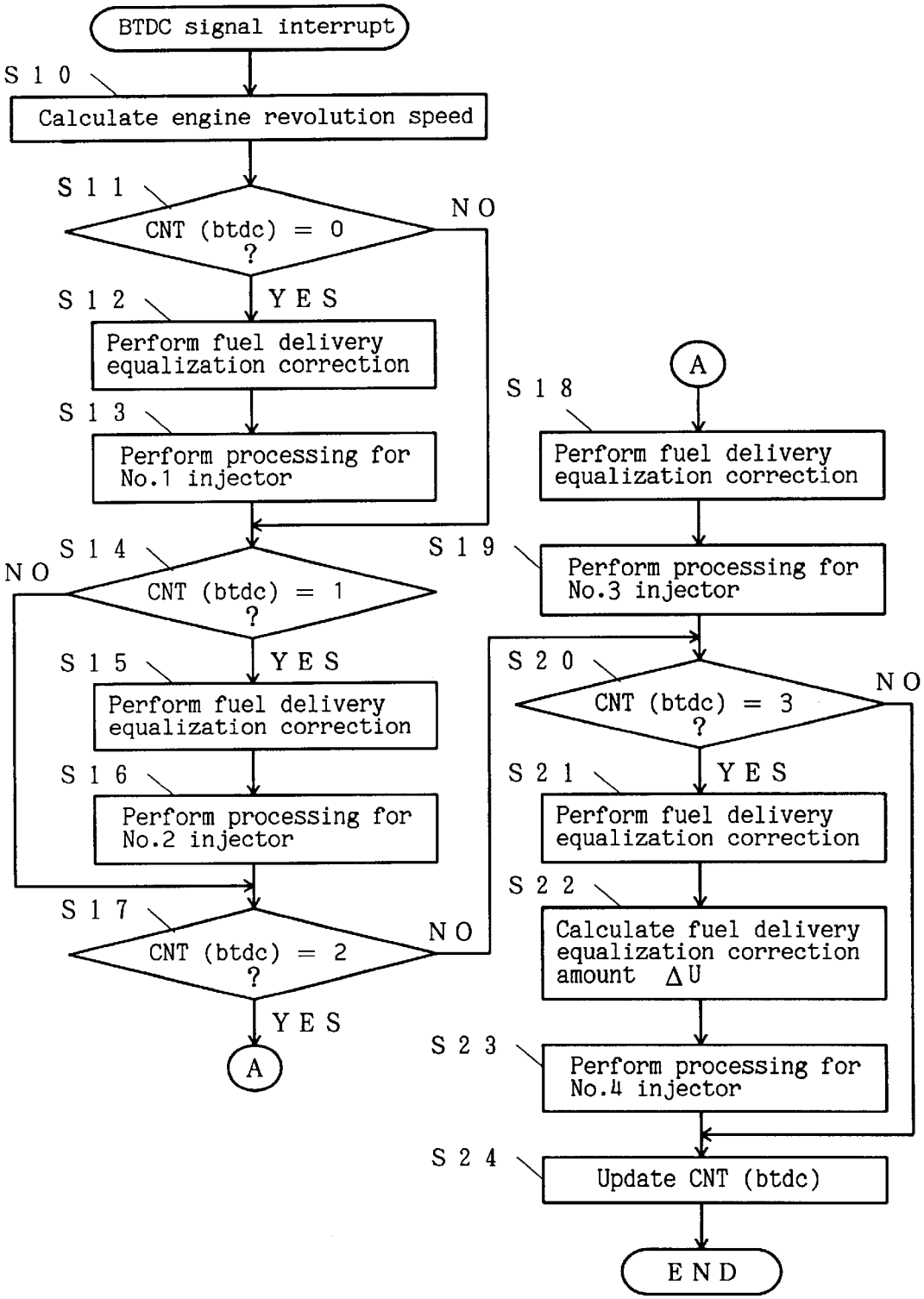
FIG. 4 is a flowchart showing an interrupt processing in the fuel injection control device of this invention generated by the BTDC signal.

(3) When step S31 decides that the change in the common rail target pressure $Pf_0$ is smaller than the threshold value and the idling state of the engine is stable, the calculation of the fuel delivery equalization correction amount ΔU(i) for each piston (i: 1–4) is performed once for each rotation of the pump. The pressure deviation ΔPf(i) determined for each pump cylinder by the fuel delivery equalization correction routine of FIG. 4 is multiplied by a gain G already obtained by experiments, and is then added to the correction amount ΔU(i) determined by the previous calculation (step S44). The calculated result is used as a present new correction amount ΔU(i) as given by the equation below (step S42).

$$\Delta U(i)=\Delta U(i)+\Delta Pf(i)\times G$$

(4) After the correction amounts Δ(i) have been obtained for i=1–4, the sum Usum of the correction amounts ΔU(i) is calculated from the equation below (step S43):

$$Usum=\Delta U(1)+\Delta U(2)+\Delta U(3)+\Delta U(4)$$

(5) Usum/4 is subtracted from each ΔU(i) and the resultant is used again to replace ΔU(i) (step S44).

$$\Delta U(i)=\Delta U(i)-Usum/4$$

With this processing, the sum of the newly replaced correction amounts becomes zero thus performing only the correction that cancels the pressure variation of the common rail, making it possible to prevent the common rail trend from producing a pressure change.

Figure 7:
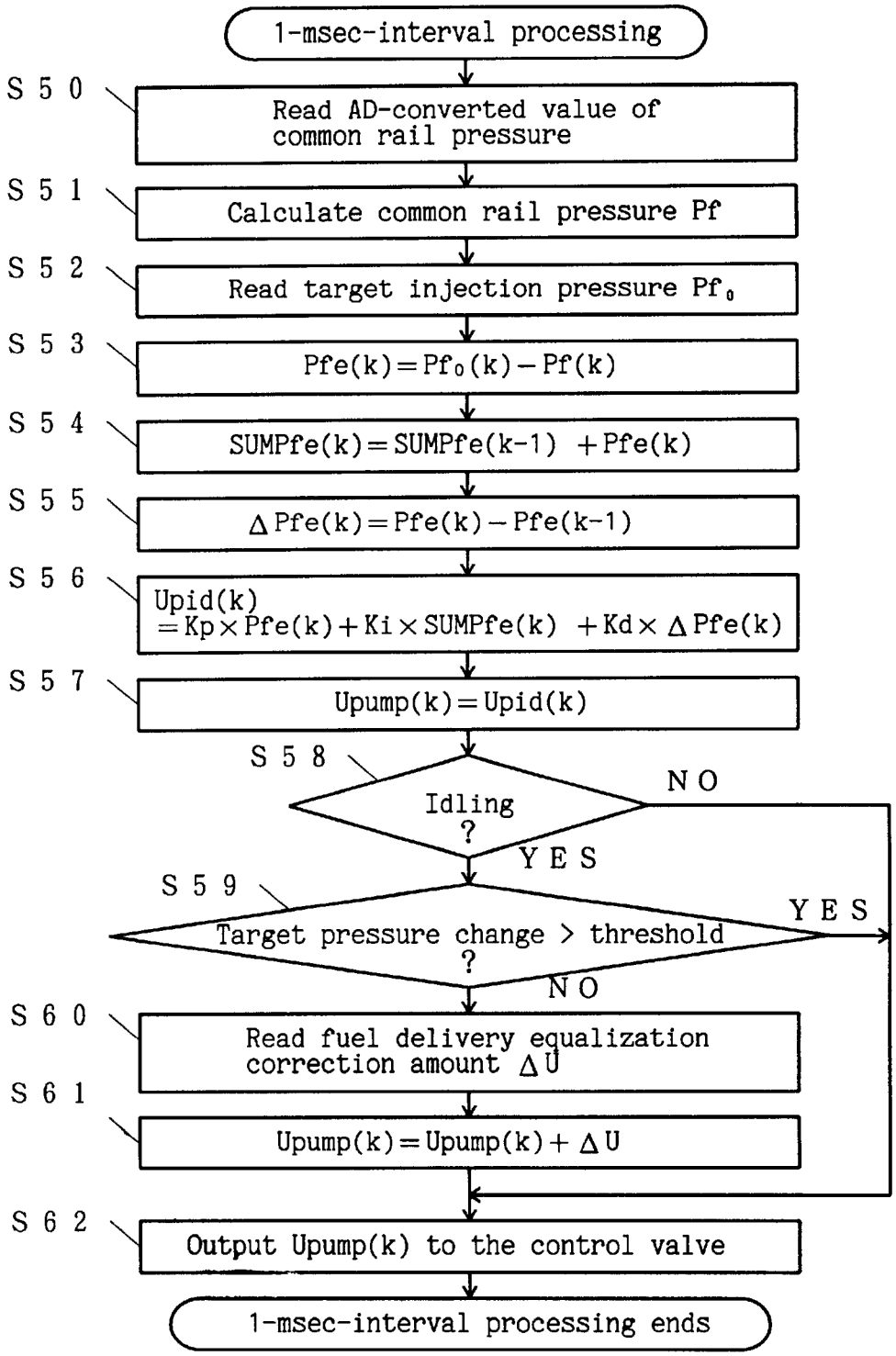
FIG. 7 is a flowchart showing the details of a common rail pressure control processing.

The common rail pressure control is processed as follows according to the flowchart shown in FIG. 7. That is, the following processing is performed by an interrupt triggered every 1 msec by a CPU-incorporated timer.

(1) The AD-converted value of the common rail pressure detected by the pressure sensor provided in the common rail is read in (step S50).

(2) The read value of step S50 is converted into the common rail pressure Pf (step S51).

(3) The common rail target pressure $Pf_0$ is read in (step S52).

(4) The deviation Pfe(k) between the common rail pressure Pf and the target pressure $Pf_0$ is determined from the following equation (step S53).

$$Pfe(k)=Pf_0(k)-Pf(k)$$

(5) The control input Upump of the pump flow control valve is calculated based on PID control. First, the deviation Pfe(k) (k: 1–4) is integrated from the following equation (step S54). It is assumed that SUMPfe(0)=0.

$$SUMPfe(k)=SUMPfe(k-1)+Pfe(k)$$

(6) A difference in the common rail pressure deviation Pfe(k) between the current cylinder and the cylinder into which the fuel was injected immediately before is determined (step S55).

$$\Delta Pfe(k)=Pfe(k)-Pfe(k-1)$$

(7) The PID control for the deviation Pfe is performed as follows. That is, as to the proportional control, the deviation Pfe itself is multiplied by a proportional control coefficient Kp. As to the integral control, the sum SUMpfe(k) of the deviations Pfe(k) is multiplied by an integral control coefficient Ki. Further, as for the differential control, the difference between the deviations Pfe(k) is multiplied by a differential control coefficient Kd. These are summed up to obtain Upid(k) (step S56). That is, $$Upid(k)=Kp\times Pfe(k)+Ki\times SUMPfe(k)+Kd\times\Delta Pfe(k)$$

(8) Upid(k) is taken to be the control input Upump(k) for the flow control valve 10 provided on the inflow side of the fuel pump 8 (step S57).

(9) It is checked whether the engine is idling (step S58). The method of decision is the same as in step S30.

(10) When the engine is found to be idling at S58, a check is made of whether the change in the common rail target pressure $Pf_0$ is larger than the threshold (i.e., the engine is not stable but is in a transient state) (step S59). When the engine is determined to be in the transient state, the processing moves to step S62.

Figure 5:
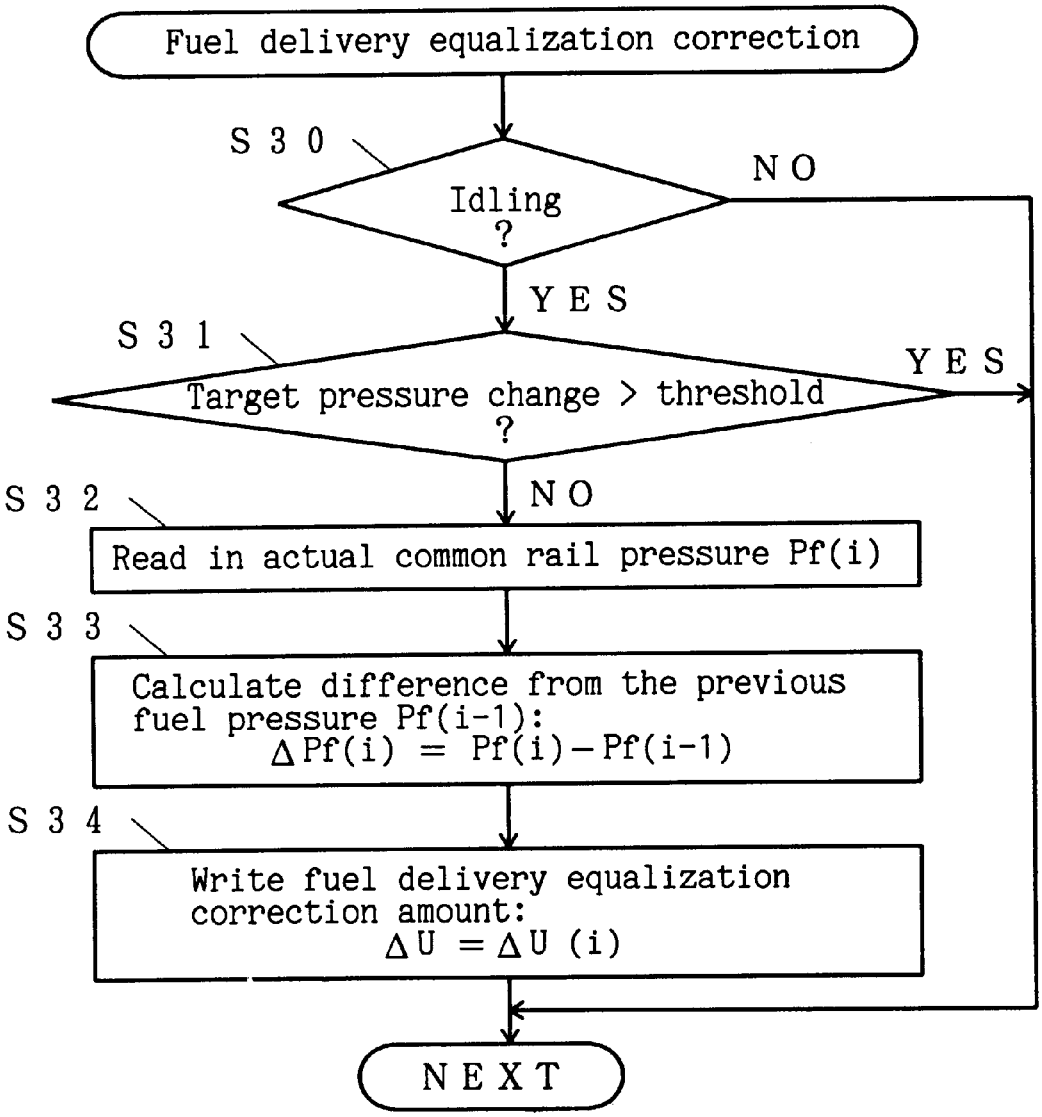
FIG. 5 is a flowchart showing the details of a fuel delivery equalization correction processing shown in FIG. 4.

(11) When step S59 decides that the change in the common rail target pressure $Pf_0$ is smaller than the threshold value and the engine is stable, the fuel delivery equalization correction amount ΔU determined by step S34 of FIG. 5 is read in (step S60).

(12) The control input of the pump flow control valve Upump(k) determined by step S57 is subjected to the fuel delivery equalization correction as expressed by the following equation and is used as the corrected control input (step S61).

$$Upump(k)=Upump(k)+\Delta U$$

(13) The Upump(k) determined by step S61 is output to the flow control valve 10, terminating the 1-msec-interval processing (step S62).

Now, the opening of the flow control valve will be explained in detail. When for example the common rail pressure falls as a result of fuel injection from the secondly-operated injector 1 as shown at Pd2 in FIG. 1, the thirdly-operated piston in the delivery stroke delivers the fuel from its pump chamber to the common rail 2 to recover the common rail pressure. At this time, if the recovered pressure Pf(2) of the common rail 2 is lower than the recovered common rail pressure Pf(1) that immediately follows the preceding fuel injection, this means that the amount of fuel delivered by the thirdly-operated piston is too small. Hence, after the fuel injections in the firstly-to fourthly-operated cylinders have been completed and the common rail pressure deviations ΔPf(i) after each fuel injection have been determined, the flow control valve 10 is controlled in the next 4-cylinder cycle in such a way as to increase the amount of fuel supplied into the pump chamber corresponding to the thirdly-operated piston when the thirdly-operated piston is in the suction stroke. Such an operation is successively repeated for each cylinder to avoid unnecessary variations in the common rail pressure while the engine is idling.

Figure 8:
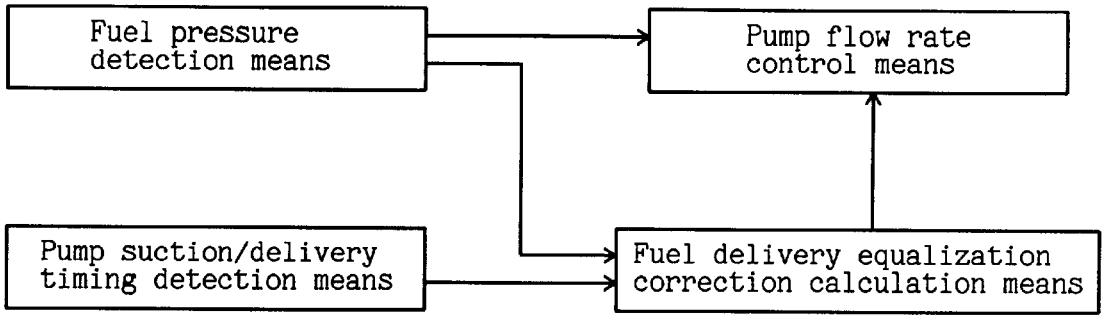
FIG. 8 is a conceptual diagram for controlling the fuel flow delivered from the fuel pump in the fuel injection control device for engines of this invention.

The fuel injection control device for engines of this invention, as shown in FIG. 8, activates the fuel delivery equalization correction calculation means for the fuel pump based on the fuel pressure detection means, i.e., the pressure sensor 13, and the pump suction/delivery timing detection means, i.e., the BTDC signal, to minimize deviations between the common rail recovery pressures provided by the fuel deliveries from different pump chambers. According to the result of the calculation of the correction amount and the result of detection by the fuel pressure detection means, the fuel injection control device controls the pump flow control means, i.e., the opening of the flow control valve provided on the inflow side of the fuel pump, in synchronism with the suction of each pump cylinder.

What is claimed is:

1. A fuel injection control device for engines comprising:

a common rail to store fuel delivered by a fuel pump;

injectors to inject fuel supplied from the common rail into combustion chambers;

a pressure sensor to detect a pressure of the common rail; and a controller to control the amount of fuel delivered from the fuel pump according to the pressure of the common rail detected by the pressure sensor;

wherein the fuel pump has pump chambers that are successively activated to deliver fuel each time the injectors have injected fuel;

wherein, based on the difference between the common rail recovery pressures provided by the fuel delivered from two successively operated pump chambers of the fuel pump, the controller controls the amount of fuel delivered by the second-operated of the two pump chambers in order to minimize variations of the common rail pressure.

2. A fuel injection control device for engines according to claim 1, wherein the control on the amount of fuel delivered by the fuel pump is performed by controlling a flow control valve provided on the inflow side of the fuel pump to control the amount of fuel supplied to the pump chambers.

3. A fuel injection control device for engines according to claim 1, wherein an operation state detection means for detecting an operating state of the engine is provided, and the controller determines a target pressure of the common rail based on the operating state of the engine detected by the operation state detection means and controls the flow control valve to match the pressure of the common rail with the target pressure.

4. A fuel injection control device for engines according to claim 3, wherein the control on the amount of fuel delivered from the fuel pump based on the difference between the recovered common rail pressures is performed when the engine operation state detected by the operation state detection means indicates idling and the target pressure of the common rail is equal to or less than a predetermined threshold value.

* * * * *